United States Patent [19]

Wescoat et al.

[11] Patent Number: 4,648,310

[45] Date of Patent: Mar. 10, 1987

[54] SMOKE VENTILATION APPARATUS AND METHOD

[76] Inventors: Jimmie E. Wescoat, 1632 S. Green, Wichita, Kans. 67211; William M. George, 1137 Burrus, Wichita, Kans. 67230

[21] Appl. No.: 831,838

[22] Filed: Feb. 24, 1986

[51] Int. Cl.[4] ..... E05F 15/20

[52] U.S. Cl. ..... 98/1; 49/4; 49/8

[58] Field of Search ..... 49/1, 3, 4, 5, 6, 7, 49/8; 52/1; 98/1, 86; 137/72, 74; 169/48

[56] References Cited

U.S. PATENT DOCUMENTS

| | | | |
|---|---|---|---|
| 2,923,226 | 2/1960 | Wasserman et al. | 52/1 X |
| 3,399,500 | 9/1968 | Shapiro | 49/8 X |
| 3,830,016 | 8/1974 | Levine | 98/86 X |
| 4,090,437 | 5/1978 | Bogaert | 49/7 X |

FOREIGN PATENT DOCUMENTS

| | | | |
|---|---|---|---|
| 170705 | 3/1960 | Sweden | 49/8 |

*Primary Examiner*—Harold Joyce

*Attorney, Agent, or Firm*—John W. Carpenter; John H. Widdowson

[57] ABSTRACT

An apparatus for controlling smoke in the event of a fire. The apparatus has a manual release arm pivotally secured to a base surface and a spring with one end attached to the base surface and the other end connected to the manual release arm. A releasing arm is pivotally connected to the base surface, and a fire linkage is pivotally secured to the base surface and releasably engages the releasing arm and the manual release arm. A bar under tension releasably engages the releasing arm such that when the releasing arm pivots and releases the bar, the bar travels away from the releasing arm due to the tension. A method for controlling smoke, or like, in the event of a fire.

11 Claims, 15 Drawing Figures

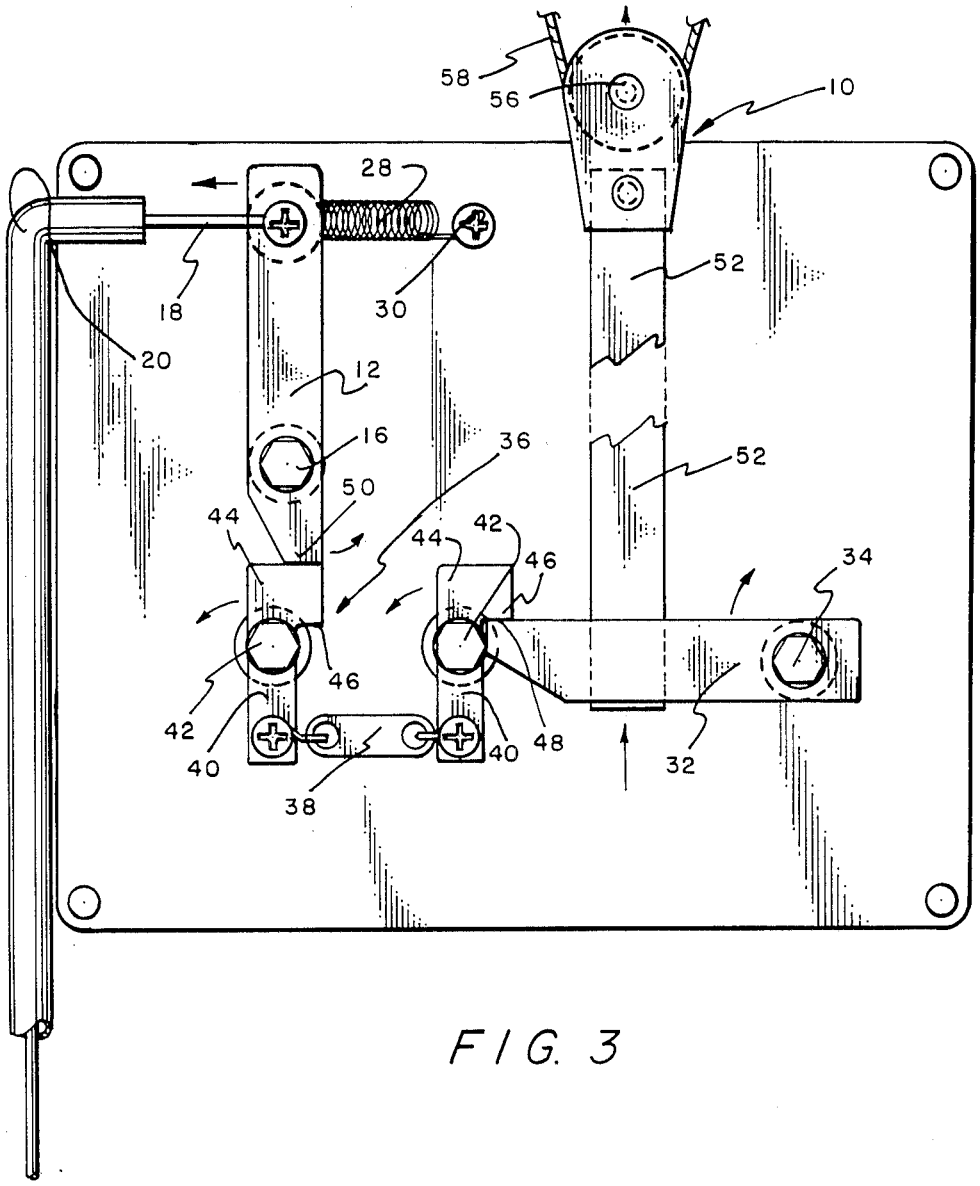
FIG. 3
FIG. 4
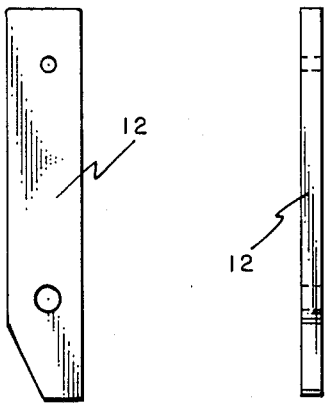
FIG. 5
FIG. 6
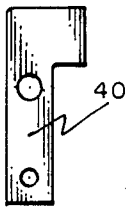
FIG. 7
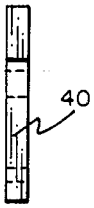
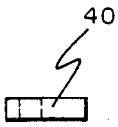
FIG. 9
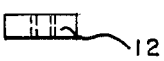
FIG. 8

FIG. 10
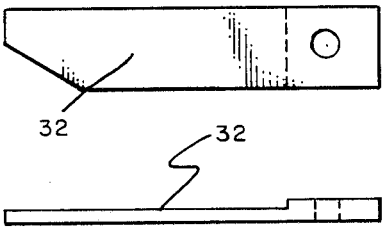
FIG. 11
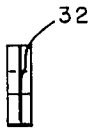
FIG. 12
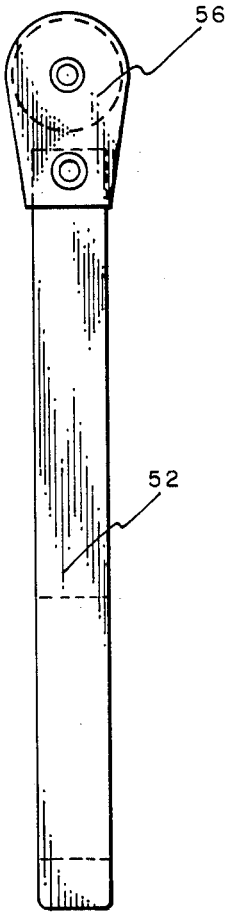
FIG. 13
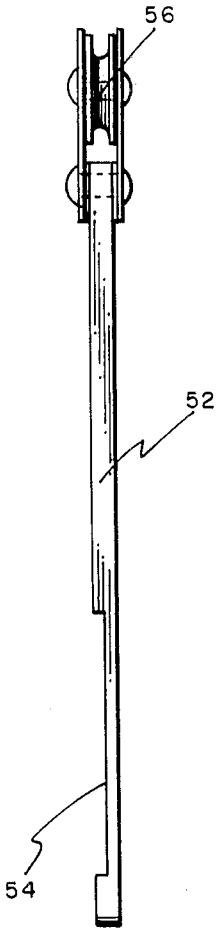
FIG. 14
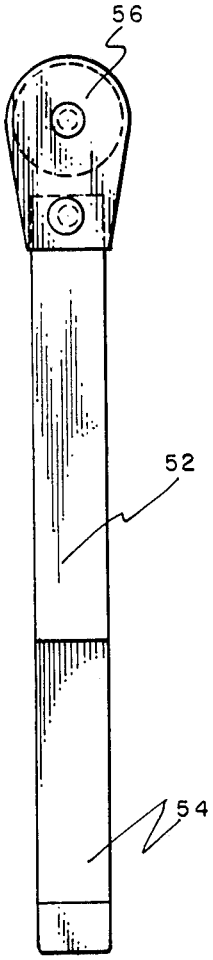
FIG. 15

SMOKE VENTILATION APPARATUS AND METHOD

BACKGROUND OF THE INVENTION

1. Field of the Invention

This invention is related to an apparatus for controlling smoke in the event of a fire. More specifically, this invention provides for an apparatus and method for controlling smoke, or the like.

2. Description of the Prior Art

U.S. Pat. No. 3,516,197 by Lyons illustrates a manually operated pair of ventilation doors on the roof of a building. Lyons also teaches a fusable connection so that in the event of the building being empty, the ventilation doors will open in case of fire. U.S. Pat. No. 3,738,253 to Jentoft teaches a smoke ventilator which may be biased open by means of a spring, and including both a fusable link and a manual cable operator to allow opening of the door in the event of a fire to enable smoke to escape. U.S. Pat. No. 3,323,438 by Korff, and U.S. Pat. Nos. 3,715,967 and 3,728,956, al to Field, disclose ventilators in the event of fire and smoke. None of the foregoing prior art patents teach or suggest the particular apparatus and method of this invention.

SUMMARY OF THE INVENTION

The present invention accomplishes its desired objects by broadly providing an apparatus for controlling smoke, or the like, in the event of a fire, or the like, comprising a manual release arm means pivotally secured to a base surface means. A spring biased means has one end attached to the base surface means and another end connected to the manual release arm means. A releasing arm means is pivotally connected to the base surface means. A fire linkage means is pivotally secured to the base surface means and releasably engages the releasing arm means and the manual release arm means. The apparatus additionally comprises a bar means under tension releasably engaged to the releasing arm means such that when the releasing arm means pivots and releases the bar means, the bar means travels away from the releasing arm means due to the tension. The present invention also accomplishes its desired objects by broadly providing a method for controlling smoke or the like, in the event of a fire, comprising the steps of securing pivotally a releasing arm means to a base surface means, and biasing pivotally the releasing arm means in a predetermined direction by slidably disposing the releasing arm means through a bar channel of a bar means under tension from a smoke controlled object means which, when positioned in a certain location, controls smoke, or the like. The method additionally comprises engaging releasably an edge of the releasing arm means by a fire linkage means, that has been pivotally mounted to the base surface means and is adapted to sever when in contact with a predetermined temperature. The releasable engagement by the fire linkage means simultaneously biases the fire linkage means to pivot in a direction opposed to the predetermined direction that the releasing arm means is pivotally biased. The method finally comprises the step of preventing the fire linkage means from pivoting in a direction opposed to the predetermined direction that the releasing arm means is pivotally biased by releasably resting against the fire linkage an end of a manual releasing arm means that has been pivotally attached to the base surface means and biased pivotally in a direction opposed to the direction that the fire linkage means is being pivotally biased by the releasing arm means.

Therefore, it is an object of the present invention to provide an apparatus for controlling smoke, or the like, in the event of a fire, or the like.

It is another object of this invention to provide a process for controlling smoke, or the like, in the event of a fire, or the like.

These, together with various ancillary objects and features will become apparent to those skilled in the art as the following description proceeds, are attained by this apparatus and process, a preferred embodiment being shown with reference to the accompanying drawing, by way of example only, wherein:

BRIEF DESCRIPTION OF THE DRAWINGS

FIG. 3 is a front elevational view of the apparatus of this invention;

FIG. 4 is a front elevational view of the manual release arm;

Figure 1:
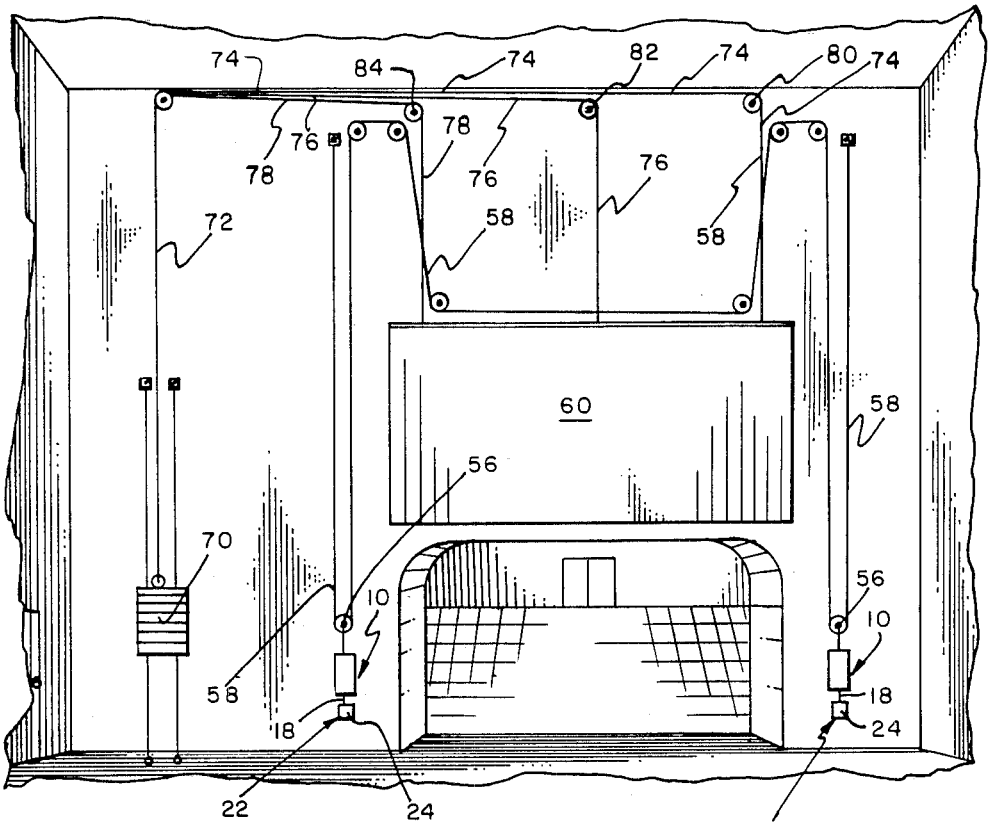
FIG. 1 is a front elevational view of the apparatus of this invention engaged to a smoke control screen which may be lowered to control fire and smoke and allow the audience to escape in safety.
Figure 2:
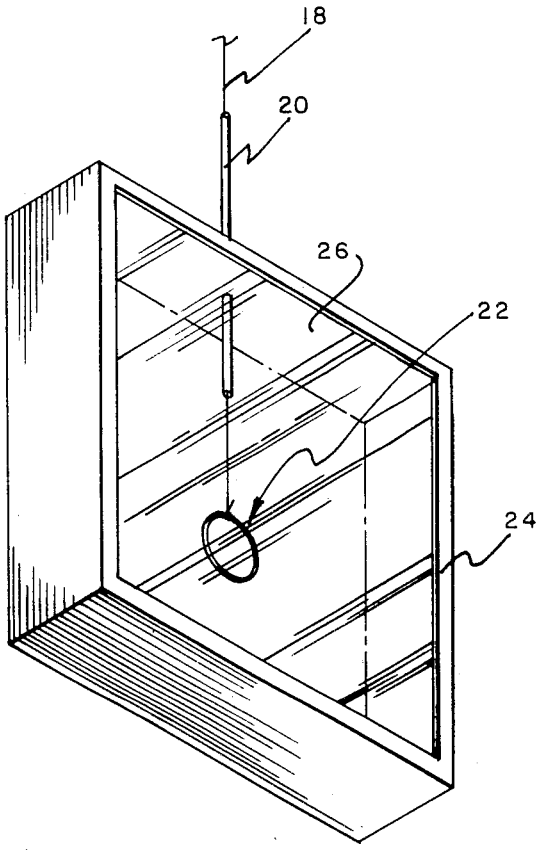
FIG. 2 is a perspective view of the box having a glass face which may be shattered in order to grasp a ring to manually activate the apparatus of this invention.

IFIG. 5 is a side elevational view of the manual release arm;

FIG. 6 is a front elevational view of a linkage arm;

FIG. 7 is a side elevational view of a linkage arm;

FIG. 8 is an end elevational view of the manual release arm;

FIG. 9 is an end elevational view of a linkage arm;

FIG. 10 is a top plan view of the releasing arm;

FIG. 11 is a side elevational view of the releasing arm;

FIG. 12 is an end elevational view of the releasing arm;

FIG. 13 is a rear elevational view of the bar that is secured to the smoke control object;

FIG. 14 is a side elevational view of the bar; and

FIG. 15 is a front elevational view of the bar.

DETAILED DESCRIPTION OF THE INVENTION

Referring in detail now to the drawings, wherein similar parts of the invention are identified by like reference numerals, there is seen an apparatus for controlling smoke, generally illustrated as 10. The apparatus 10 includes a manual release arm 12 which is pivotally secured to a base surface 14 by a bolt 16. A cord 18 secures to the upper portion of the manual release arm 12 and extends therefrom, through a guide conduit 20 down to a pull ring, generally illustrated as 22, which has been encased in a box 24 having a glass face 26. A spring 28 is provided with one of its ends secured to the base surface 14 at 30 with its other end connected to the manual release arm 12 for biasing the manual release arm 12 towards the connection point 30 where the end of the spring connects to the base surface 14.

A releasing arm 32 is pivotably connected to the base surface 14 by a bolt 34. A fire linkage means, generally illustrated as 36, is pivotably secured to the base surface 14. The fire linkage means 36 comprises a generally U-shaped structure having a fire link base 38 (e.g. thermal metal, plastic, etc.) which is adapted to sever or melt when it is exposed to a predetermined temperature. The generally U-shaped fire linkage structure 36 additionally comprises a pair of linkage arms 40—40 which is respectively pivotably secured to the base structure by bolts 42—42. Each of the linkage arms 40—40 include an end 44 having a protruding lip 46. The protruding lip 46 of one of the linkage arms 40 engages an edge 48 of the releasing arm 32 while the end 50 of the manual release arm 12 releasably rests against the end 44 of the other linkage arm 40 to prevent the entire U-shaped fire linkage 36 from pivoting.

The apparatus 10 additionally comprises a bar 52 which has a channel 54 (see FIG. 14) in proximity to one end, and a sheath means 56 which is secured to the other end. The sheath means 56 is engaged by a rope or line 58 which is connected to a smoke control object, such as a curtain 60 (see FIG. 1), that may be lowered in the event of a fire, for example on a stage, or the like as also illustrated in FIG. 1. The curtain 60 of FIG. 1 also preferably has an existing counter weight 70 secured to a line 72 that also connects to lines 74, 76 and 78 respectively over sheaves 80, 82, and 84, all part of the existing curtain support system for the curtain 60.

The line 58 may be secured to any kind of object which can control or ventilate smoke, for example, ventilated doors on the roof of buildings, or the like. The smoke control object is generally weighted (or under tension) which places tension, stress or upwardly urging on the bar 52 via line 58. The releasing arm 32 removably, slidably passes through the bar channel 54, as illustrated in FIG. 4. Since bar 52 is under tension, when the releasing arm 32 engages the bar channel 54, this subjects the releasing arm 32 to an upward urge. The upward urge is controlled or prevented, resisted by connecting the edge 48 of the releasing arm 32 under the protruding lip 46 of one of the linkage arms 40.

In the event that the fire linkage means 36 is pivotally rotated, either manually or from the fire link arm 32 severing, the upwardly urged edge 48 of the releasing arm 32 is released from underneath the protruding lip 46 of the linkage arm 40. The releasing arm 32 then commences to slide through the bar channel 54 of the bar 52 to eventually become disengaged therefrom and enable the bar 52 to be released to generally travel upwardly from the tension that has been placed thereon from the smoke control object. If the smoke control object is the curtain 60, gravity would cause the curtain 60 to be lowered, pulling the existing counter weight 70 with it which would cause the latter to travel upward (see FIG. 1). The smoke or fire would then be contained behind the curtain 60, enabling the audience to leave the theatre in safety.

In the event that it is desired to manually release the smoke control object, the glass face 26 on the box 24 is broken and ring 22 is grasped and pulled, causing cord 18 to pivot manual release arm 12 counter-clockwise about the bolt 16, causing end 50 of the manual release arm 12 to be released from against the end 44 of one of the linkage arms 40. Edge 48 of the releasing arm 32 under an upward bias against lip 46 of one of the linkage arms 40, causes the entire fire linkage means 36, to rotate counter-clockwise about bolts 42—42 until the edge 48 is released from the lip 46. Releasing arm 32 now travels through the bar channel 54 of the bar 52, as previously mentioned, and releases the bar 52 to travel upwardly in order to dispose the smoke control object in a desired position. If the heat from the fire severs or melts fire link base 38, only the linkage arm 40, having its lip 46 engaged to the edge 48 of the releasing arm 32, is rotated counter-clockwise to release edge 48 and enabling releasing arm 32 to travel upwardly to displace the smoke control object.

The other linkage arm 40, having its end 44 engaged releasably to the end 50 of the manual release arm 12, remains in place. Spring 28 biases the manual release arm 12 clockwise to maintain end 50 of the manual release arm 12 against the end 44 of linkage arm 40 that doesn't rotate in the event that the heat from a fire melts or severs the fire link base 38.

While the present invention has been described herein with reference to particular embodiments thereof, a latutide of modification, various changes and substitutions are intended in the foregoing disclosure, and it will be appreciated that in some instances, some features of the invention will be employed without a corresponding use of other features, without departing from the scope of the invention as set forth.

We claim:

1. An apparatus for controlling smoke, or the like, in the event of a fire, or the like, comprising a manual release arm means pivotally secured to a base surface means;

a spring bias means having one end attached to the base surface means and another end connected to the manual release arm means;

a releasing arm means pivotally connected to the base surface means;

a fire linkage means pivotally secured to the base surface means and releasably engaged to the releasing arm means and to the manual release arm means; and a bar means under tension releasably engaging to said releasing arm means such that when the releasing arm means pivots and releases said bar means, the bar means travels away from said releasing arm means due to the tension.

2. The apparatus of claim 1 additionally comprising a cord means attached to said manual release arm means in proximity to where the spring bias means attaches to said manual release arm means.

3. The apparatus of claim 2 wherein said bar means has a structure defining a bar channel wherethrough said releasing arm means removably passes.

4. The apparatus of claim 3 wherein said fire linkage means comprises a generally U-shaped structure including a fire link base adapted to sever when in contact with a predetermined temperature, and a pair of linkage arms, each linkage arm being pivotally secured to said base surface means with at least one of said pair of linkage arms having a lip which lodges over an edge of the releasing arm means that is being pivotally urged upwardly by the bar means having the tension thereon.

5. The apparatus of claim 4 wherein said pair of linkage arms each include an end with a protruding lip, the lip of the end of one linkage arm engages the edge of said releasing arm means while an end of said manual release arm means releasably rests against the end of the other linkage arm to prevent the entire U-shaped fire linkage means from pivoting and releasing the upwardly urged edge of the releasing arm means from underneath the lip of the linkage arm that engages the same, which is turn causes the releasing arm means to commence sliding through the bar channel of the bar means to eventually become disengaged therefrom and enable the bar means to be released to generally travel upwardly from the tension thereon.

6. The apparatus of claim 5 additionally comprising a sheave means secured to an end of said bar means, said sheave means adapted to receive a line means under tension from holding a smoke control object means.

7. The apparatus of claim 6 additionally comprising a handle member attached to said cord means in order to manually pull the cord means to pivot the manual release arm means and disengage same from the U-shaped fire linkage means.

8. A method for controlling smoke, or the like, in the event of a fire comprising the steps of:

(a) securing pivotally a releasing arm means to a base surface means;

(b) biasing pivotally the releasing arm means in a predetermined direction by slidably disposing the releasing arm means through a bar channel of a bar means under tension from a smoke control object means which when positioned in a certain location controls smoke, or the like;

(c) engaging releasably an edge of the releasing arm means by a fire linkage means that has been pivotally mounted to said base surface means and is adapted to sever when in contact with a predetermined temperature, said releasable engagement by the fire linkage means simultaneously biases the fire linkage means to pivot in a direction opposed to the predetermined direction that said releasing arm means is pivotally biased in step (b); and (d) preventing the fire linkage means from pivoting in the direction opposed to the predetermined direction that said releasing arm means is pivotally biased by releasably resting against the fire linkage means on an end of a manual release arm means that has been pivotally attached to said base surface means and biased pivotally in a direction opposed to the direction that the fire linkage means is being pivotally biased by the releasing arm means.

9. The method of claim 8 additionally comprising severing said fire linkage means by subjecting the same to said predetermined temperature.

10. The method of claim 9 wherein said severing releases the edge of said releasing arm means from said engagement with said fire linkage means which subsequently causes the releasing arm means to commence sliding through the bar channel of the bar means to eventually become disengaged therefrom and enable the bar means to be released to generally travel upwardly from the tension thereon by the smoke control object which is being positioned to control the smoke.

11. The method of claim 8 additionally comprising pulling the manual release arm means with a cord means in a direction opposed to the direction that the manual release arm is being biased in order to release the end of the manual release arm from resting against the fire linkage means, causing the fire linkage means to pivot and release the releasing arm means which releases the bar means and the smoke control object to position the same to control the smoke.

* * * * *